US006760051B2

(12) United States Patent
Fujii et al.

(10) Patent No.: US 6,760,051 B2
(45) Date of Patent: Jul. 6, 2004

(54) IMAGE FORMING APPARATUS WITH SWITCHING ELEMENTS

(75) Inventors: Haruo Fujii, Kanagawa (JP); Fumihiko Arishima, Ibaraki (JP); Yujiro Ando, Kanagawa (JP); Hiroki Kisu, Kanagawa (JP); Shigeki Kondo, Kanagawa (JP); Masaaki Matsushima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 10/084,170

(22) Filed: Feb. 28, 2002

(65) Prior Publication Data

US 2002/0126195 A1 Sep. 12, 2002

(30) Foreign Application Priority Data

Feb. 28, 2001 (JP) ..... 2001-055244
Nov. 1, 2001 (JP) ..... 2001-336964

(51) Int. Cl.[7] ..... B41J 2/385; B41J 2/40; B41J 2/405; G03G 9/08

(52) U.S. Cl. ..... 347/141; 347/142; 347/153; 347/158

(58) Field of Search ..... 347/112, 141, 347/140, 153, 158, 142

(56) References Cited

U.S. PATENT DOCUMENTS 3,997,973 A 12/1976 Buss
4,441,791 A 4/1984 Hornbeck
4,502,062 A * 2/1985 Kunst ..... 347/141
4,748,464 A * 5/1988 Pannekoek et al. ..... 347/141
5,539,440 A * 7/1996 Higuchi et al. ..... 347/112
6,049,681 A * 4/2000 Shiozawa et al.
6,100,909 A * 8/2000 Haas et al. ..... 347/141
6,389,260 B1 * 5/2002 Kataoka et al.
6,618,065 B2 * 9/2003 Koga et al. ..... 347/141
2002/0158956 A1 * 10/2002 Van Der Meer et al. ... 347/141

FOREIGN PATENT DOCUMENTS

JP 57154260 A * 9/1982 ..... G03G/15/00

* cited by examiner

*Primary Examiner*—Susan S.Y. Lee
(74) *Attorney, Agent, or Firm*—Fitzpatrick, Cella, Harper & Scinto

(57) ABSTRACT

An image forming apparatus is provided, with which it is possible to reduce the overall size of an apparatus. The image forming apparatus includes an image bearing member including a plurality of switching elements that are arranged in a moving direction and a generatrix direction of the image bearing member, and a latent image forming unit for forming a latent image on the image bearing member, the latent image forming unit including a voltage generating unit for generating a voltage in each switching element in accordance with an image signal.

18 Claims, 11 Drawing Sheets

IMAGE FORMING APPARATUS WITH SWITCHING ELEMENTS

BACKGROUND OF THE INVENTION

1. Field of the Invention

The present invention relates to an image forming apparatus, such as a printer, a copying machine, or a facsimile.

2. Related Background Art

Conventionally, as a method of recording an image on a recording material (for instance, paper or a transparent film), there have been widely known an electrophotographic method, a magnetic recording method, an ink-jet method, and the like.

Among these methods, with the electrophotographic method, the surface of a photosensitive member (photosensitive drum or photosensitive belt) constructed by applying or evaporating an optical semiconductor onto the surface of a conductive drum or belt is evenly charged. Then, a charged latent image (electrostatic latent image) is formed by irradiating the charged surface with light corresponding to image information, a toner image (visualized image) is formed by allowing toner (colored particles) to adhere in accordance with electric lines of force from charges, the toner image is transferred onto a recording material, and an image is formed by fixing the toner image on the surface of the recording material through heating and pressurizing.

Next, with the magnetic recording method, a material for holding magnetism is provided instead of an optical semiconductor, the magnetism holding material is magnetized in accordance with image information, and image formation is performed by allowing magnetic colored particles to be attracted by each magnetized portion.

Finally, with the ink jet recording method, fine particles of ink are directly sprayed on a recording material, thereby forming an image.

In general, each of the electrophotographic method, the magnetic recording method, and the ink-jet method described above has its inherent problem described below.

With the electrophotographic method, image formation is performed through an image forming process including charging, exposure, development, transfer, fixation, and cleaning that are performed in succession, so that the image forming process becomes complicated and the number of process devices is increased accordingly. As a result, the overall size of an image forming apparatus tends to be enlarged.

Also, with the magnetic recording method, it becomes possible to simplify an image forming process, in comparison with the case of the aforementioned electrophotographic method. However, it is required to use magnetic substances as colored particles and the magnetic substances assume darkened colors. As a result, it is difficult to clearly form a color image in colors (yellow, magenta, cyan) other than black.

With the ink jet recording method, there are obtained various advantages. For instance, it is possible to reduce the size of an apparatus and to manufacture the apparatus at low cost. However, the time taken by image formation is long and therefore this method is not suitable for the use in an office or a company in which it is required to print documents in large quantity.

SUMMARY OF THE INVENTION

The present invention has been made in view of the above, and an object of the present invention is to provide an image forming apparatus with which it is possible to reduce the overall size of an apparatus.

Another object of the present invention is to provide an image forming apparatus that is suitable for the formation of a clear image and, in particular, suitable for the formation of a color image.

Still another object of the present invention is to provide an image forming apparatus with which it is possible to shorten the time taken by the formation of an image.

Other objects and features of the present invention will become further clear from the detailed description given below in conjunction with the accompanying drawings.

DESCRIPTION OF THE PREFERRED EMBODIMENTS

Figure 1:
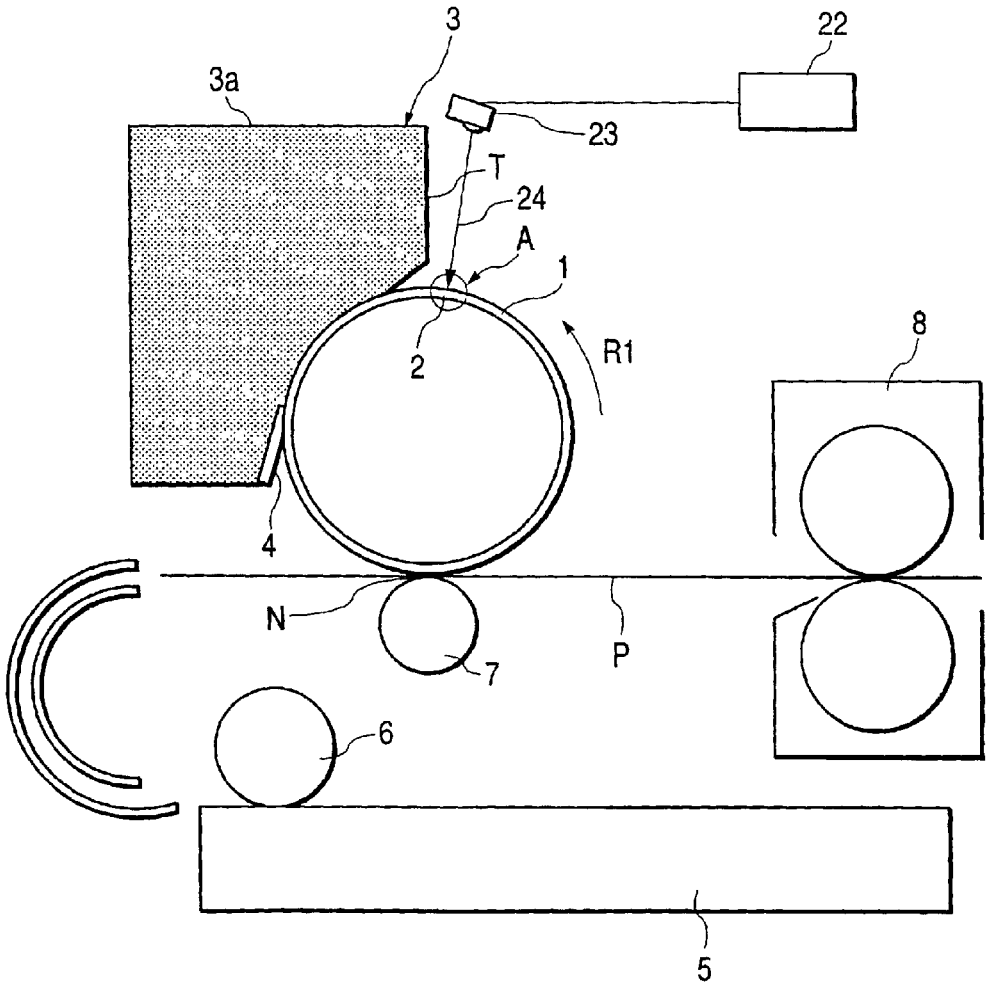
FIG. 1 is a vertical cross-sectional view showing the outline of a construction of an image forming apparatus of the first embodiment.

Embodiments of the present invention will be described below with reference to the drawings. Note that in each drawing referred to in the following description, members and the like given the same reference numeral have the same construction and function. Therefore, the repetitive description of such members and the like will be omitted as appropriate.

(First Embodiment)

FIG. 1 shows an example of an image forming apparatus according to the present invention. This drawing is a vertical cross-sectional view showing the outline of the construction of the image forming apparatus. Note that in the following description, each member will be described using specific numeric values, although the present invention is not limited to these numeric values.

The image forming apparatus shown in this drawing includes a drum (image bearing member) 1 on whose surface a latent image (electric latent image) is formed, a switching element 2 that is provided on the surface of the drum 1 and forms the electric latent image, a developing device (developing means) 3 that contains charged toner (colored and charged particles) and develops the aforementioned electric latent image as a toner image by allowing the toner to adhere to the electric latent image, a blade (removing means) 4 for scraping the toner off the surface of the drum 1, a sheet feeding cassette (recording material containing means) 5 in which a recording material (such as paper or transparent films) P is contained, a sheet feeding roller (supplying means) 6 that feeds the recording material P from the sheet feeding cassette 5, a transferring roller (transferring means) 7 that transfers the toner image on the drum surface to the recording material P, and a fixing device (fixing means) 8 that fixes the toner image on the recording material P.

The drum 1 described above is a cylindrical member made of aluminum whose diameter is 20 mm, and a plurality of divided pixels of an X-Y array (a large number of switching elements 2 arranged in the generatrix direction and the peripheral direction (moving direction) of the drum 1) are formed on the surface (outer peripheral surface) of the drum 1. The peripheral length of the drum 1 in the moving direction is an integral multiple of one pixel (one dot). A signal generating apparatus 22 generates an electrical signal corresponding to an image pattern and drives a laser diode (light-emitting unit) 23 in accordance with this electrical signal. When laser signal light 24 generated in this manner is inputted into the switching element 2 as an image signal (image information), a voltage is generated on the upper surface of each pixel in accordance with the level of the electrical signal corresponding to the image pattern. Note that the pixel and the switching element 2 will be described in detail later.

When the drum 1 is rotated in the direction of arrow R1 at a peripheral speed (process speed) of 50 mm/sec and an electrical signal corresponding to the image pattern is inputted into a portion A, there is generated an electric latent image in each pixel described above in accordance with the image pattern. Toner T contained in a developer container (colored and charged particle container) 3*a* of the developing device 3 adheres to the surface of the drum 1 in accordance with this electric latent image, thereby forming a toner image. Note that in this embodiment, a non-magnetic one-component developer is used as developer. Accordingly, the developer is the same as the toner T. As the toner, there is used black toner that is available from Canon Sales Co., Inc. for a printer whose trade name is LBP2040. The toner T in the developer container 3*a* also adheres to portions of the surface of the drum 1 that do not contribute to formation of a toner image. However, this toner T is scraped off the surface of the drum 1 by the blade 4 and returns to the inside of the developer container 3 for reuse. The blade 4 is, for instance, an elastic rubber, a thin-layer metal, or the like that has been formed to have a plate shape.

The recording material P contained in the sheet feeding cassette 5 is supplied one by one by the sheet feeding roller 6 in synchronization with the toner image formed on the surface of the drum 1. This recording material P is supplied to a transferring nip portion N formed between the drum 1 and the transferring roller 7 and is nipped and conveyed by this transferring nip portion N. During this operation, the toner image on the surface of the drum 1 is transferred to the surface of the recording material P by the transferring roller 7. Note that as necessary, an electric field may be formed in the transferring nip portion N between the transferring roller 7 and the drum 1 in a direction in which the toner T is attracted by the recording material P.

The toner image transferred onto the surface of the recording material P is melted to adhere (is fixed) to the surface of the recording material P by a fixing device 8 that heats and pressurizes the toner image. In this manner, the image formation is finished.

Figure 2:
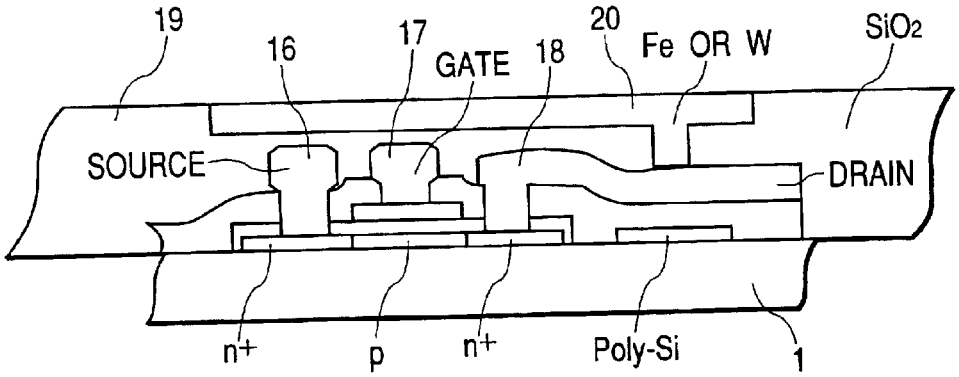
FIG. 2 is a vertical cross-sectional view of a switching element (pixel)

FIG. 2 is a vertical cross-sectional view of one pixel of the switching element 2 formed on the surface of the drum 1 of the image forming apparatus shown in FIG. 1. Also, FIGS. 3A to 3G show steps of manufacturing the pixel shown in FIG. 2. Note that it is possible to manufacture the switching element 2 using an apparatus that is used to manufacture a semiconductor integrated circuit.

Figure 3A:
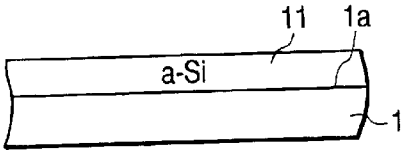
FIGS. 3A, 3B, 3C, 3D, 3E, 3F and 3G are diagrams illustrating steps of manufacturing the switching element.
Figure 3B:
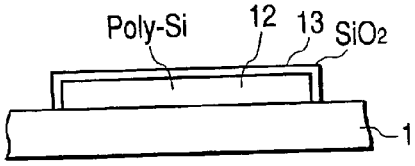
Figure 3C:
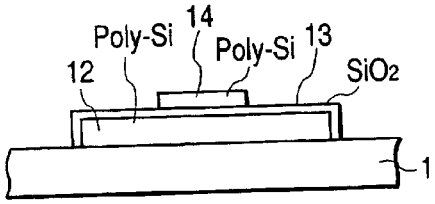

In FIG. 3A, an amorphous silicon (a-Si) film 11 is evaporated onto a surface 1*a* of the drum 1 made of aluminum to have a thickness of around 1000 Å. Then, an excimer laser (wavelength hv=308 nm, energy: 1300 mJ/cm$^2$) is applied for around 35 msec and processing for converting the film into polysilicon is performed, thereby forming a polysilicon (Poly-Si) substrate 12. Following this, the polysilicon substrate 12 is divided so that each pixel is independent of one another. In addition, as shown in FIG. 3B, a silicon oxide film ($SiO_2$ film) 13 is formed as a surface layer. Following this, as shown in FIG. 3C, a polysilicon (Poly-Si) film 14 that will become a gate electrode is formed by photolithographic etching. Instead of this polysilicon film 14, there may be used a tungsten-silicon film, a titanium-silicon film, an aluminum film, or the like.

Figure 3D:
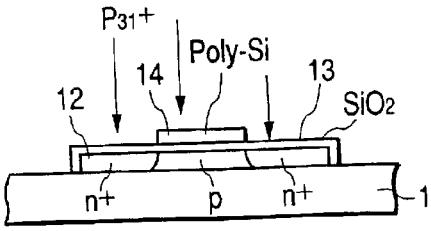
Figure 3E:
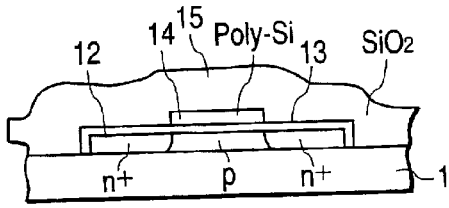
Figure 3F:
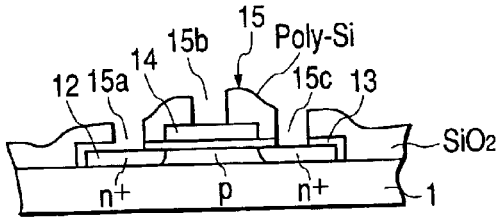
Figure 3G:
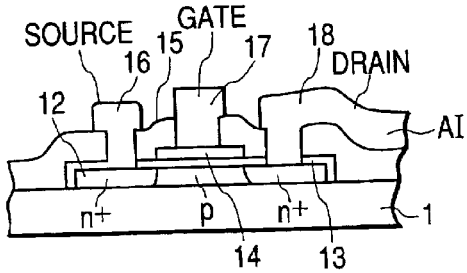

FIG. 3D shows a state where $P_{31}^+$ ions are injected with a self-align technique. Following this, as shown in FIG. 3E, a silicon oxide film 15 is formed using a deposition technique. Further, as shown in FIG. 3F, opening portions 15*a*, 15*b*, and 15*c* are provided by photolithographic etching. Then, as shown in FIG. 3G, a source 16, a gate 17, and a drain 18 are formed by depositing aluminum.

It is preferable that as shown in FIG. 2, following this, the surface is coated with an insulating layer 19 made of silicon oxide or the like. During this process, to flatten the projections and depressions of the surface, it is preferable that the flattening is performed through CMP (chemical-mechanical-polishing) processing or the like. Also, as will be described later, as necessary, a metallic electrode (image forming electrode for forming an latent image) 20 formed using iron (Fe), tungsten (W), or the like, which has conductivity to some extent, may be deposited so as to be connected to the drain 18.

Figure 4:
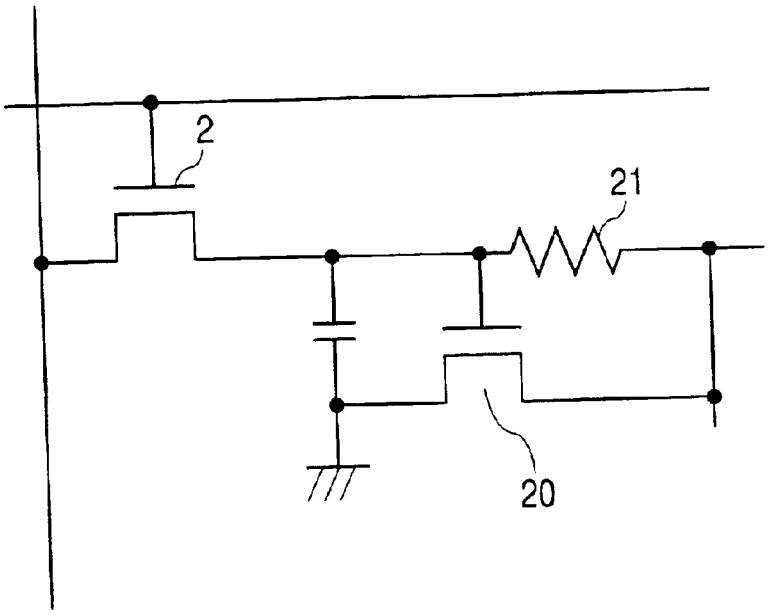
FIG. 4 is a diagram illustrating a metallic electrode that is electrically connected to the switching element at an intersection point of XY matrix wiring.

FIG. 4 shows the metallic electrode (pixel electrode) 20 that is electrically connected to the switching element 2 at an intersection point of XY matrix wiring. Further, the metallic electrode 20 doubles as a heater and is added with a heating element (circuit) 21 that generates Joule heat.

Figure 5:
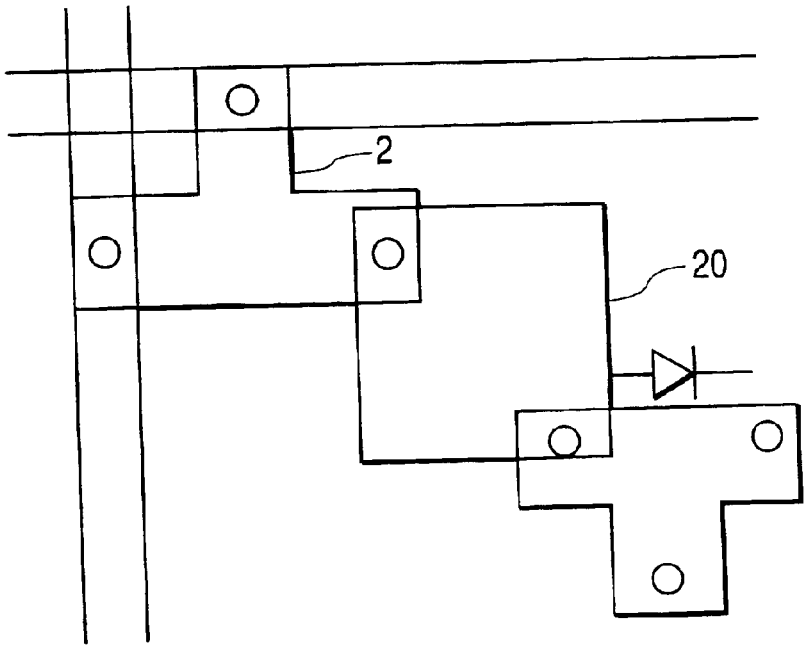
FIG. 5 is a diagram illustrating one pixel formed on the surface of a drum 1 using the component shown in FIG. 2 and the component shown in FIG. 4.

FIG. 5 shows one pixel formed on the surface of the drum 1 by the components shown in FIGS. 4 and 2.

Figure 6:
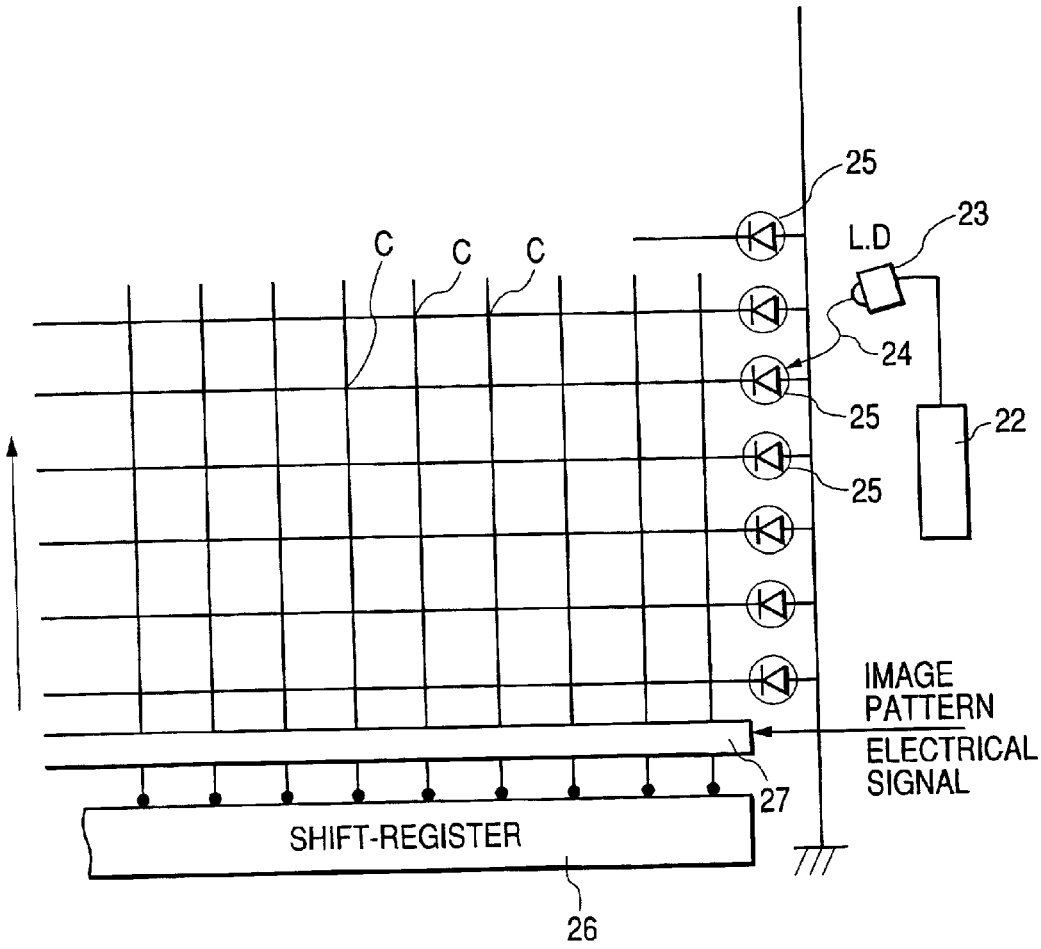
FIG. 6 is a diagram illustrating a construction for forming an electric latent image on the drum surface.

FIG. 6 shows the one pixel shown in FIG. 5 on the X and Y matrix and shows a state where the laser diode 23 is driven by the electrical signal corresponding to the image pattern generated in the signal generating apparatus 22 and the laser signal light 24 generated by this driving operation is irradiated onto a photodiode (light-receiving unit) 25 formed on the drum 1 as an image signal.

An optical communications means is constructed by the laser diode 23 and the photodiode 25 described above. Note that instead of the optical communications means, there may be used a radio wave communications means that uses a LAN, an SS communications method, a spread spectrum communications method, or the like between the aforementioned drum 1 and the main body, a handy terminal, or the like. In this case, there is obtained an advantage that the flexibility of a location is obtained and it becomes possible to perform image communications even if the main body is not provided with an image transmission side. Also, it becomes possible to directly write an image from a communication means like a mobile telephone.

Also, a sampling circuit 27 for the electrical signal corresponding to the image pattern driven by a shift-register 26 is connected to an intersection point line crossing the photodiode 25, thereby allowing the switching element 2 for image formation to be driven for each pixel by the action described above. The aforementioned photodiode 25 is provided in an area of the surface of the drum 1, in which no image is formed, which is to say in a non-image area (non-image forming area).

The method of forming the aforementioned pixels and the method of driving the pixels are described in detail, for instance, in U.S. Pat. No. 3,997,973, U.S. Pat. No. 4,441,791, and the like.

It should be noted here that as to the image signal, signal light from the laser diode 23 or an LED (not shown) arranged on the image forming apparatus main body side is received by a photodiode (light signal detecting element) arranged on a part of the drum 1 and the switching element 2 is driven in accordance with the level of the signal light. Alternatively, a radio wave transmitter for transmitting a signal may be provided on the image forming apparatus main body side and a receiver may be provided on the drum 1. In this case, image information is temporarily obtained by the receiver and is inputted into each switching element 2.

Also, as to the aforementioned light signal detecting element and receiver, it is preferable that patterns thereof are formed beforehand during the formation of the switching element 2 on the drum 1.

With the technique of this embodiment, it becomes possible to directly form an electric latent image on the drum 1. As a result, a primary electrostatic charger and an exposing device that have been conventionally required in an image forming apparatus adopting the electrophotographic method become unnecessary and therefore it becomes possible to simplify the overall construction of an image forming apparatus. Also, with the conventional magnetic recording method, it is required that colored particles to be used have magnetism. However, with the technique of this embodiment, it becomes possible to use non-magnetic colored particles. This makes it possible to clearly form a color image in colors (for instance, yellow, magenta, and cyan) other than black. Further, unlike an image forming apparatus adopting the conventional ink-jet method, it is easy to accelerate image formation.

(Second Embodiment)

Figure 7:
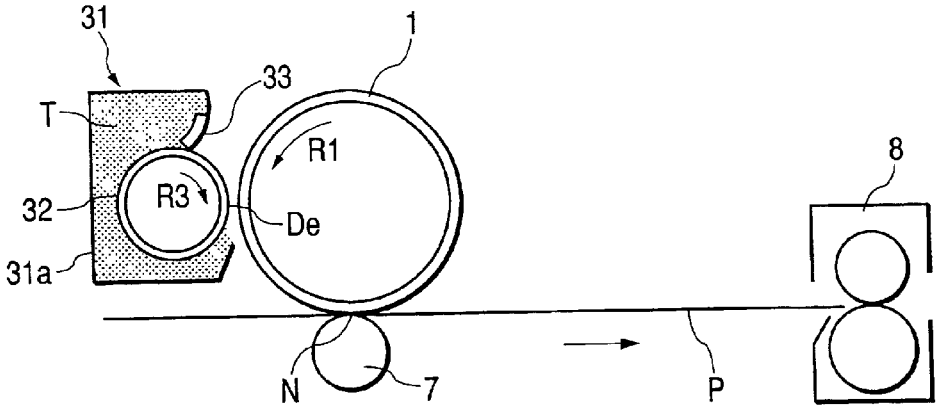
FIG. 7 is a diagram illustrating the outline of a construction of an image forming apparatus of the second embodiment.

FIG. 7 shows a second embodiment. An image forming apparatus shown in this drawing differs from the image forming apparatus of the first embodiment shown in FIG. 1 in the construction of the developing device 31. Other constructions of this embodiment are the same as those of the first embodiment.

In the developer container 31*a* of the developing device 31, there is provided a developing sleeve (developer carrying member) 32 made of cylindrical aluminum whose diameter is 15 mm. This developing sleeve 32 is arranged so as to oppose the drum 1. Also, the developing sleeve 32 is rotated so that the moving direction (the direction of arrow R3) of the surface of the developing sleeve 32 becomes the same as the moving direction (the direction of arrow R1) of the surface of the drum 1 and the relative velocity therebetween becomes approximately zero during the rotation. A blade 33 that is the same as the blade 4 in FIG. 1 is made to abut against the surface of this developing sleeve 32. With this construction, the toner T is evenly applied onto the surface of the developing sleeve 32 and the toner T applied on the surface of the developing sleeve 32 is charged by friction between the blade 33 and the developing sleeve 32. Constructions other than the developing device 31 are the same as those of the image forming apparatus shown in FIG. 1.

As to the drum 1 in this embodiment, like the drum 1 described with reference to FIG. 1, an electrical signal corresponding to an image pattern is held by each pixel. Therefore, the toner T on the surface of the developing sleeve 32 opposing each pixel is attracted and adheres thereon in accordance with the amount of electricity in each pixel.

The toner T adhering onto the drum 1 is transferred, by the transferring roller 7, onto the recording material P that is fed from the sheet feeding cassette (see FIG. 1) by the sheet feeding roller (see FIG. 1) and is conveyed to the transferring nip portion N. The toner image transferred onto the recording material P in this manner is fixed onto the surface of the recording material P by the fixing device 8 that heats and pressurizes the toner image.

It should be noted here that as necessary, a DC electric field, an AC electric field, or an electric field, in which a DC electric field and an AC electric field are superimposed on each other, may be formed as a transferring bias between the drum 1 and the transferring roller 7.

(Third Embodiment)

Figure 8:
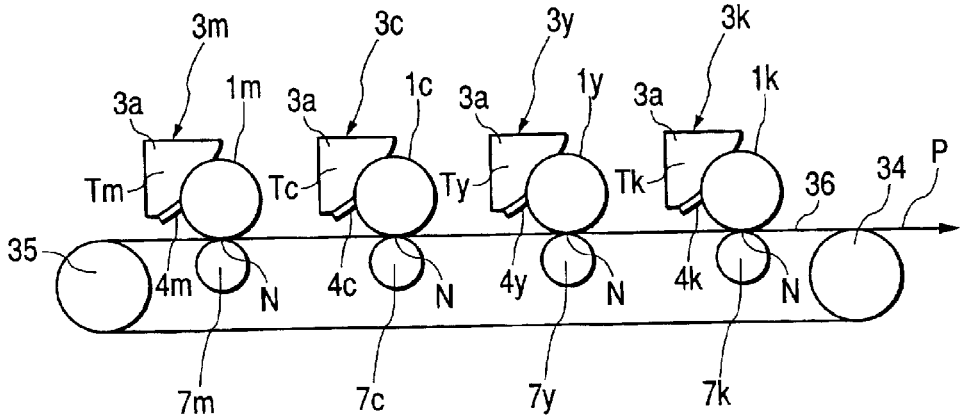
FIG. 8 is a vertical cross-sectional view showing the outline of a construction of an image forming apparatus of the third embodiment.

FIG. 8 shows an image forming apparatus according to this third embodiment. The image forming apparatus shown in this drawing is an image forming apparatus that includes four image forming portions (image forming stations) and is capable of forming a full-color image using four colors. That is, four sets including a drum, a developing device, and a transferring roller that are the same as the drum 1, the developing device 3, and the transferring roller 7 in the image forming apparatus of the first embodiment shown in FIG. 1 are arranged in sequence from the upstream side in a direction in which the recording material P is conveyed. With this construction, there is formed a toner image in each color of magenta, cyan, yellow, and black in this order.

The image forming portions in respective colors include: drums 1*m*, 1*c*, 1*y*, and 1*k* that are arranged parallel to each other; developing devices 3*m*, 3*c*, 3*y*, and 3*k* that contain toner Tm, Tc, Ty, and Tk in magenta, cyan, yellow, and black and are arranged so as to oppose the respective drums 1*m*, 1*c*, 1*y*, and 1*k*; blades 4*m*, 4*c*, 4*y*, and 4*k* for scraping unnecessary toner adhering on the surfaces of the drums 1*m*, 1*c*, 1*y*, and 1*k*; and transferring rollers 7*m*, 7*c*, 7*y*, and 7*k* for transferring toner on the drums 1*m*, 1*c*, 1*y*, and 1*k* onto the recording material P. Further, a transferring belt 36 running between the rollers 34 and 35 is arranged so as to pass through each image forming portion. Under a condition where the recording material P is held on the surface of the transferring belt 36, the transferring belt 36 conveys this recording material P to the transferring nip portions N of the image forming portions for magenta, cyan, yellow, and black in succession.

Each of the drums 1*m*, 1*c*, 1*y*, and 1*k* described above is provided with switching elements 2 that are the same as those of the first embodiment and an electrical signal divided into an image pattern in magenta, cyan, yellow, or black is inputted into each switching element 2. As a result of this operation, an electric latent image corresponding to each color is formed on the surface of one of the drums 1*m*, 1*c*, 1*y*, and 1*k*. Then, these electric latent images are developed by toner Tm, Tc, Ty, and Tk in magenta, cyan, yellow, and black contained in the developer containers 3*a* of the developing devices 3*m*, 3*c*, 3*y*, and 3*k* as toner images in respective colors. These toner images are transferred in succession onto the recording material P, which has been fed from the sheet feeding cassette (see FIG. 1) by the sheet feeding roller (see FIG. 1) or the like and been held on the surface of the transferring belt 36, by the transferring rollers 7*m*, 7*c*, 7*y*, and 7*k*. As a result, the toner images are superimposed on each other. The recording material P, on which the toner images in four colors have been transferred, is separated from the transferring belt 36 and is heated and pressurized by the fixing device (see FIG. 1). As a result, the toner images in four colors are fixed on the surface of the recording material P. In this manner, there is formed a full-color image using four colors.

As to the aforementioned toner in each color of magenta, cyan, yellow, and black, there is used toner that is available from Canon Sales Co., Inc. for a printer whose trade name is LBP2040.

It should be noted here that in the above description in this embodiment, there has been described an example in which there are used four image forming portions that each are the same as that described in the first embodiment with reference to FIG. 1. However, instead of this construction, there may be used four image forming portions that are each the same as that described in the second embodiment with reference to FIG. 7.

Also, in the above description, the recording material P is held on the surface of the transferring belt 36 and is conveyed. However, instead of the transferring belt 36 having a belt shape, there may be used a transferring drum (not shown) having a drum shape. Further, each toner image formed on the drum 1 may be primarily transferred onto an intermediate transferring member (not shown), such as an intermediate transferring belt or an intermediate transferring drum temporarily. Then, these toner images may be secondarily transferred from this intermediate transferring member onto the recording material P by one operation.

(Fourth Embodiment)

A fourth embodiment is characterized in that the developer contained in the developer container of the developing device is two-component developer.

In the first to third embodiments described above, the developer adhering to the electric latent image on the drum 1 is non-magnetic one-component developer. However, in this embodiment, there is used two-component developer whose main ingredients are carrier and toner. The carrier is, for instance, made of iron powder. In the case of the two-component developer like this, it is preferable that the mixture ratio between the carrier and toner, which is to say the ratio of the toner to the total volume of the developer, is maintained constant. This is because the density of a toner image varies if this ratio changes.

Even in the case where the two-component developer like this is used, it is possible to achieve an effect that is the same as the effect obtained in the case where the one-component developer is used.

As a developing method used in the present invention, cascade development, touch-down development, spray development, one-component contact development, or the like that have conventionally been known may be adopted. That is, as the developing method in the present invention, it is possible to use an arbitrarily developing method (apparatus) so long as it is possible to carry developer to a position (developing position) De (see FIG. 7) at which toner will adhere to the electric latent image on the drum.

In the above first to fourth embodiments, there has not been described how toner will be supplied. However, it is preferable that a toner supplying device is provided, the amount of toner remaining in the developer container is detected as necessary, and a certain amount of toner is contained in the developer container at all times. This is because the density of a toner image also varies in accordance with the amount of toner in the developer container.

(Fifth Embodiment)

The developer used in the present invention is not limited to powdery developer but it is also possible to use liquid developer. For instance, the toner T described above may be dispersed in an insulation liquid (for instance, ISOPER produced by Esso Sekiyu K.K.) obtained by refining kerosene or the like. In this case, image formation is performed by having the dispersion liquid contact the surface of the drum 1 on which an electric latent image has been formed.

(Sixth Embodiment)

In a sixth embodiment, the switching element 2 and the heating element 21 described with reference to FIGS. 4 and 5 are formed as a single component. By having the switching element 2 operate during image formation (development) and having the heating element 21 operate during transferring, it becomes possible to perform both of the image formation and the transfer heating using the drum 1. Also, by giving a signal that is the same as the electrical signal during recording to the heating element 21 during a transferring step, it becomes possible to heat only the toner T without heating the recording material P to a high temperature. This makes it possible to prevent energy wasting. Needless to say, all of the heating elements 21 described above may be driven in the transferring nip portion N.

Also, in the case where the recording material P is heated and pressurized in the fixing device 8, there tends to occur curls and wrinkles of the recording material P. However, in this embodiment, only each portion of the recording material P, in which the toner T exists, is heated, so that there hardly occur the curls and wrinkles.

(Seventh Embodiment)

In the above sixth embodiment, there has been described a case where the switching element 2 and the heating element 21 are separately operated. However, the operation of the heating element 21 may be controlled by the output from the switching element 2.

(Eighth Embodiment)

Figure 9:
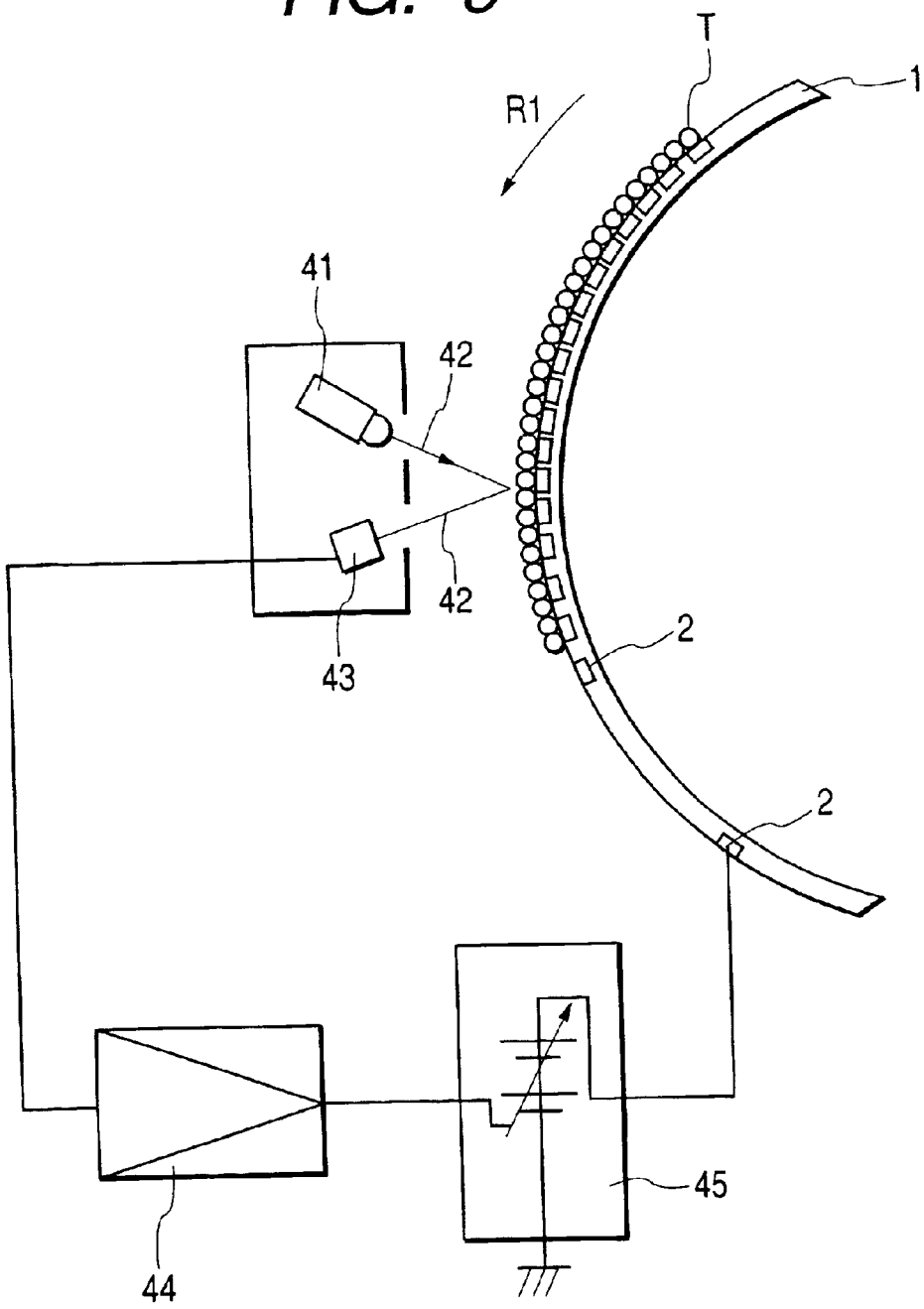
FIG. 9 is a diagram illustrating a state where a voltage to be applied to the switching element is set in accordance with a toner density on the drum in the eighth embodiment.

An eighth embodiment will be described with reference to FIG. 9. FIG. 9 is a partial cross-sectional view of the image forming apparatus that has been described with reference to FIG. 1. Light 42 emitted from a light-emitting element 41 of a density detecting means having the light-emitting element 41 and a light-receiving element 43 is reflected by the toner T that is attracted to the drum 1 by the switching element 2. The amount of reflection light during this operation varies in accordance with the amount of adhering toner T. The reflection light 42 is received by the light-receiving element 43 and a detection signal of the light-receiving element 43 is inputted into an amplifier circuit 44 and the voltage of a power source 45 of the switching element 2 is adjusted (set) by a signal from the amplifier circuit 44 to have a desired value corresponding to a toner density.

It should be noted here that the toner density on the drum 1 is measured in the above description, although it is possible to obtain the same effect even if the toner T on the recording material P is measured.

Also, in this embodiment, there has been described a case where the voltage of the switching element 2 is adjusted on the basis of a detection result of the density detecting means. However, it is possible to achieve the same effect even if a voltage applied to the developing sleeve 32 is adjusted (set) on the basis of the detection result of the density detecting means in the image forming apparatus described with reference to FIGS. 7 and 8.

Also, as to the number of pixels that are the switching elements 2 on the drum 1, it is preferable that if the peripheral length of the drum 1 is referred to as M and the pixel density is referred to as D (to be described later), the values of M and D are set so that M/D becomes an integer.

Also, a method of forming the switching elements is shown in FIGS. 3A to 3G. However, aside from this method, the switching element 2 described with reference to FIGS. 3A to 3G may be, for instance, formed on a plastic substrate recommended in a document "Low Temperature Poly-Si TFTs on Plastic Substrate Using Surface Free Technology by Laser Ablation/Annealing", 916•SID 00 DIGEST, Seiko Epson Corporation. In this case, this plastic substrate is wounded around the drum 1. It has been confirmed that it is possible to obtain the same effect even with this construction.

Figure 10A:
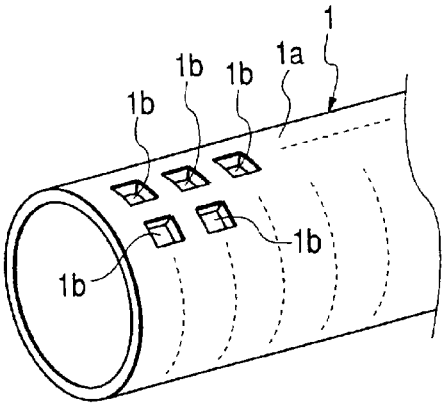
FIGS. 10A, 10B and 10C are diagrams illustrating another method of manufacturing the switching element.
Figure 10B:
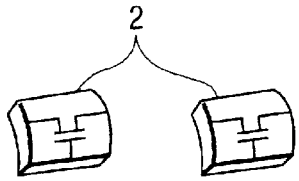
Figure 10C:
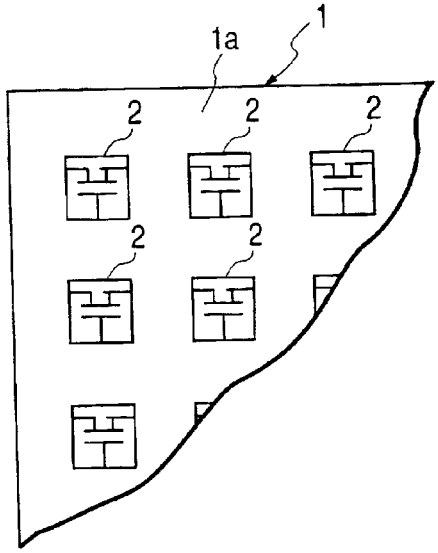

Also, as shown in FIGS. 10A, 10B, and 10C, grooves 1*b*, in each of which it is possible to bury a switching element 2, are provided on the surface 1*a* of the drum 1 beforehand. On the other hand, each switching element 2 described with reference to FIGS. 3A to 3G may be independently formed on a chip whose each side is 20 to 40 $\mu$m, these chips may be fitted into each groove 1*b*, and each switching element 2 may be connected to each other.

Also, as necessary, a carbon nanotube may be allowed to grow on a switching element electrode.

Also, as necessary, an electrode group may be protected by a protecting layer formed using a thin film made of fluororesin or SiC (silicon carbide) whose thickness is in a range of from 1 $\mu$m to 50 $\mu$m.

In the above description, there has been described a case where a silicon (Si) substrate is used. However, even in the case of another semiconductor material, such as an organic semiconductor, zinc oxide, or selenium, it is possible to obtain the same effect by independently forming switching elements on the upper surface of the drum 1.

(Ninth Embodiment)

In this embodiment, there are prevented stains on an image caused by the adhesion of unnecessary toner, which does not contribute to image formation, on the drum. Note that as the reason why the image stains occur, there may be cited a phenomenon where an electric field supplied to a switching element array leaks from a power source line and attracts toner from a toner container.

Figure 11:
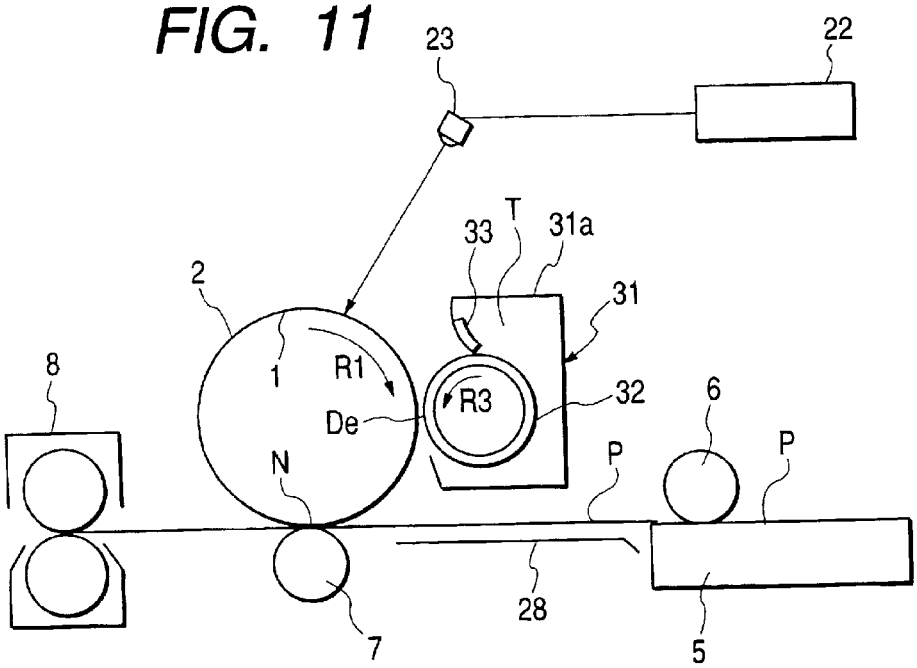
FIG. 11 is a vertical cross-sectional view showing the outline of a construction of an image forming apparatus of the ninth embodiment.
Figure 12:
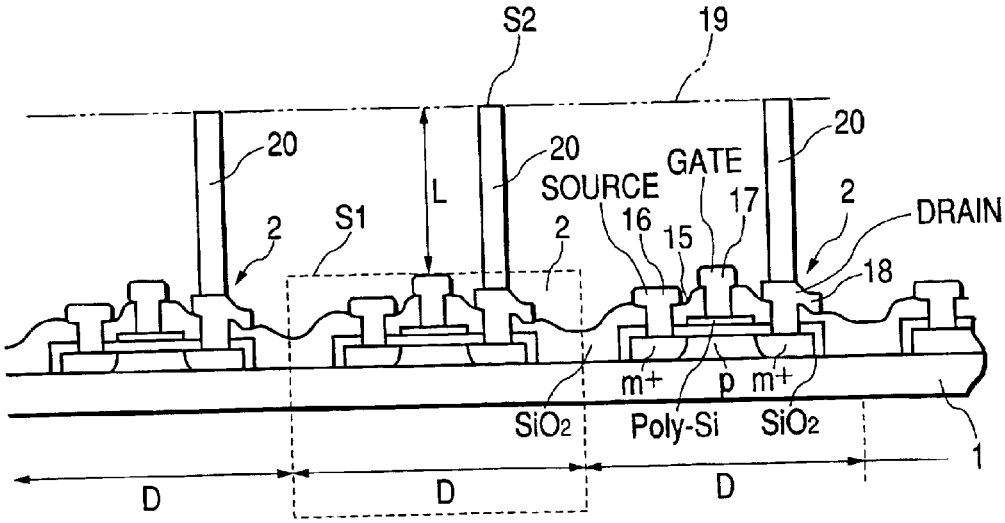
FIG. 12 is a vertical cross-sectional view of a switching element of the ninth embodiment.

FIG. 11 is a vertical cross-sectional view showing the outline of the construction of an image forming apparatus according to this embodiment. Also, FIG. 12 is a simplified cross-sectional view showing a partial cross section of the drum 1. Note that FIG. 12 shows a cross section of switching elements 2, which are a plurality of pixels, to simplify the description of the construction of the switching element array formed on the surface of the drum 1. A conductive metallic electrode 20 is formed for (connected to) the drain 18 of each switching element 2. This embodiment is characterized in that this metallic electrode 20 is arranged at a position that is closer to the developing position De of the developing sleeve 32 than other electrodes (source 16 and gate 17).

As shown in FIGS. 12 and 6, when a voltage of 50 V is applied to the source 16 and an electrical signal corresponding to an image pattern is inputted from the signal generating apparatus 22 to the laser diode 23 of the optical communications means, the laser diode 23 emits light in accordance with the electrical signal. This emitted light is received by the photodiode 25 provided at an end portion (non-image area) of the surface of the drum 1 in the axial direction. Also, the electrical signal corresponding to the image pattern and the signal from the shift-register 26 are converted into an electrical signal at the X-Y intersection point C of the switching element array on the drum 1. This converted electrical signal is given to the gate 17 of the aforementioned switching element 2 and a voltage is generated in the drain 18 in accordance with the level of the electrical signal. Then, the same voltage is generated in the metallic electrode 20. The toner T that coats the developing sleeve 32 (see FIG. 11) as a thin layer is attracted by this voltage, thereby forming a toner image (visible image) on the drum 1.

Figure 13:
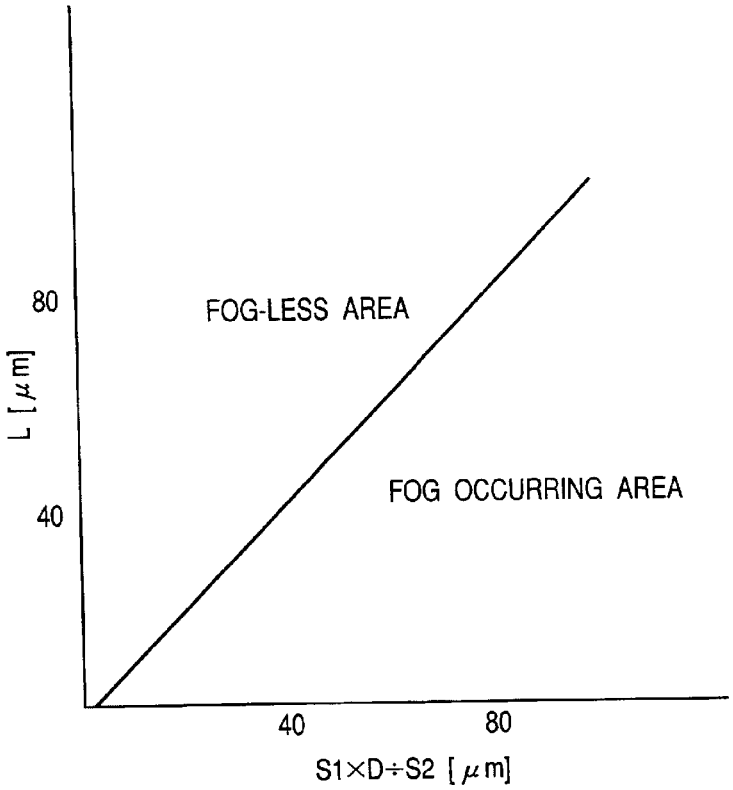
FIG. 13 is a diagram illustrating a relation between "S1×D/S2" and "L"
Figures 14A, 14B, 14C, 14D:
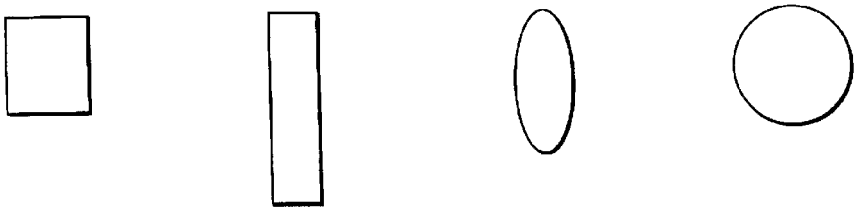
FIGS. 14A, 14B, 14C and 14D are diagrams illustrating the shapes of cross sections of metallic electrodes that differ from each other.

FIG. 13 shows a result obtained from experiments as to a condition where toner adheres to a non-image area in the case where image formation is performed using the image forming apparatus shown in FIG. 11. In this drawing, the horizontal axis represents a value obtained from a calculation "S1×D/S2" where S1 (see FIG. 12) is the cross-sectional area of one pixel (cross-sectional area in a direction approximately along the drum surface), D is a pixel density, and S2 (see FIG. 12) is the cross-sectional area of the metallic electrode 20 (electrode projection cross-sectional area: cross-sectional area in a direction approximately along the drum surface). Also, the vertical axis represents a value of a (projection) length L of the metallic electrode 20 from the top plane of the switching element 2. That is, this drawing shows a relation between "S1×D/S2" and "L".

The applicant of the present invention has found that the amount of toner adhering to a non-image area is reduced in accordance with the increase of the length of the metallic electrode 20 described above. Also, it turned out that as to the relation described above, if the length "L" becomes at least equal to a result of the calculation "S1×D/S2", unnecessary toner does not adhere to the drum 1 with regard to use. This may be because the metallic electrode 20 described above shields an unnecessary electric field from a power source line, the source 16, the gate 17, and the like of the switching element 2 and therefore the toner on the developing electrode (developing sleeve 32) is not attracted by the power source line, the source 16, the gate 17, and the like. An approximately constant relation is maintained between the calculation "S1×D/S2" and the value "L" even if the pixel density is changed from 300 dpi to 2400 dpi. Also, a fog on the drum 1 does not significantly change. It has also been found that although various other modifications, such as the changing of the pixel density to 600×1200 dpi, are conceivable, the relational expression described above may be applied as it is because the cross-sectional area of the metallic electrode 20 also changes accordingly. This may be because a state where the toner adheres to the non-image area was judged through visual observation. However, there occurs no problem with regard to use. Also, no significant effect is caused by the positional relation between the metallic electrode 20 and the switching element 2.

FIGS. 14A, 14B, 14C, and 14D are each a drawing of another example of the metallic electrode 20 taken from the upper surface of the drum 1. As shown in these drawings, the shape of the metallic electrode 20 may be changed in various ways, such as a square, a rectangle, an ellipse, or a circle. In this case, there occurs no problem when a point, at which the maximum cross-sectional area is obtained, is used as the cross-sectional area S of the metallic electrode 20 and this maximum cross-sectional area is applied to the relational expression described above. Also, the shape of the metallic electrode 20 when viewed in the direction shown in FIG. 12 may be determined so that a portion thereof close to the drain 18 is narrowed and the cross-sectional area is increased in accordance with the reduction of a distance to the surface of the drum 1 (to the upper side of this drawing). Alternatively, the metallic electrode 20 may have a shape where the central portion swells.

The shape of the metallic electrode 20 will be described in more detail with reference to FIGS. 11 and 6.

In FIG. 11, the drum 1 is obtained by forming the switching elements 2 described with reference to FIGS. 2, 3A to 3G as an X-Y array of 600 dots per inch (600 dpi) on an aluminum cylinder. During this formation, one pixel of 600 dpi is set as around 43 $\mu$m, the area S1 of pixels per dot is around 43 $\mu$m×43 $\mu$m, the cross-sectional area S2 of the metallic electrode 20 is set as 20 $\mu$m×20 $\mu$m, and the height (projection height) L of the metallic electrode 20 is set as 10 $\mu$m.

The drum 1 is moved by a driving source (not shown) in the arrow direction at a speed of 50 mm/sec. An image signal from the signal generating device 22 is supplied to the laser diode 23, the laser diode 23 emits light in accordance with an image pattern, and the emitted light is supplied to the photodiode 25 on the drum 1. The image pattern expressed by the received light is converted into an electrical signal, and the metallic electrode 20 of the switching element 2 group of the X-Y array on the drum 1 obtains an electric latent image corresponding to this image pattern as a result of this conversion.

As shown in FIG. 11, the drum 1 is arranged so as to oppose the surface of the developing sleeve 32 that is made of a metal to have a diameter of 15 mm and is contained in the developer container 31*a*, with a distance of 150 $\mu$m being maintained therebetween. Also, the developing sleeve 32 is rotatively driven in the direction of arrow R3, this developing sleeve 32 carries the toner T in the developer container 31*a*, and the toner T is applied as a thin layer by an elastic blade 33 made of rubber. As the toner T, there is used black toner that is available from Canon Sales Co., Inc. for a printer whose trade name is LBP2040. Also, the peripheral speed of the surface of the developing sleeve 32 is set so that the relative velocity with the surface of the drum 1 becomes approximately zero.

The toner T in the developer container 31*a* of the developing device 31 is attracted by the drum 1 at the developing position De in accordance with the electric latent image on the drum 1, thereby forming a toner image. The toner image formed in this manner moves to the transferring nip portion N in accordance with the rotation of the drum 1 in the direction of arrow R1.

On the other hand, the recording material P is sent from the sheet feeding cassette 5 in synchronization with the toner image on the drum 1 described above, is guided by a recording material guide 28, and is conveyed to the transferring nip portion N. The recording material P is pressed against the drum 1 by the transferring roller 7 and the toner image is transferred onto the surface of the recording material P. It is preferable that during this operation, a voltage (transferring bias) that moves the toner image on the drum 1 to the recording material P side is applied to the transferring roller 7. In more detail, in this embodiment, a transferring bias of +500 V is applied to the transferring roller 7.

The recording material P, on which the toner image has been transferred, is conveyed to the fixing device 8, at which the recording material P is nipped and conveyed by a fixing nip portion between the fixing roller and a pressurizing roller. As a result, this recording material P is heated and pressurized and the toner image is fixed on the surface of the recording material P.

An image formed in the manner described above becomes a clear image without toner fogs.

It should be noted here that in this embodiment, there has been described a case where the switching element 2 and the metallic electrode 20 on the drum 1 are exposed on the surface of the drum 1. However, in actual cases, as indicated by the two-dot chain line in FIG. 12, it is preferable that an insulating layer 19 made of $SiO_2$, fluororesin, or the like is provided on the surface of the drum 1 so as to cover the switching element 2 and the metallic electrode 20.

Also, even in the case where there are formed dots of 1200×600 dpi, 2400×600 dpi, or the like to have a shape that is not a square, the metallic electrodes 20 are produced so that the spaces between these metallic electrodes are electrically isolated or these metallic electrodes 20 are separately produced to prevent the occurrence of crosstalk in usual cases. Therefore, in the case where the shape of the cross section of each metallic electrode 20 is determined so as to be similar to the shape of the pixel described above, it is enough that during the calculation of the length L of the metallic electrode 20, a numerical value of a short side of one pixel is used to calculate S1. For instance, if the short side is referred to as "a", S1 may be obtained performing a calculation=a×a.

Also, in the above description, there has been described a case where the metallic electrode 20 is produced at the drain 18. However, for instance, in the case where a switching element of transistor type or another type is used, if an element that controls the output obtained for an input signal is used, the metallic electrode may be formed on the output side of the element.

Also, the shape of the upper surface of the pixel described above is a square or a rectangle. However, there occurs no problem even if the shape of the cross section of the metallic electrode 20 is similar to the pixel or has a shape other than the similar shape, such as an ellipse or a circle.

Also, the metallic electrode 20 described above may be produced with a method with which an Au (gold) layer is provided on the drain 18, an Si film is allowed to grow in an Au—Si (silicon) melt solution, an Si single crystal is plated with Ni (nickel), Au, and Pd (palladium) to form a laminate structure using $SiCl_4$—$H_2$ steam. Alternatively, as to the metallic electrode 20, a carbon nanotube may be used as an electrode.

(Tenth Embodiment)

Figure 15A:
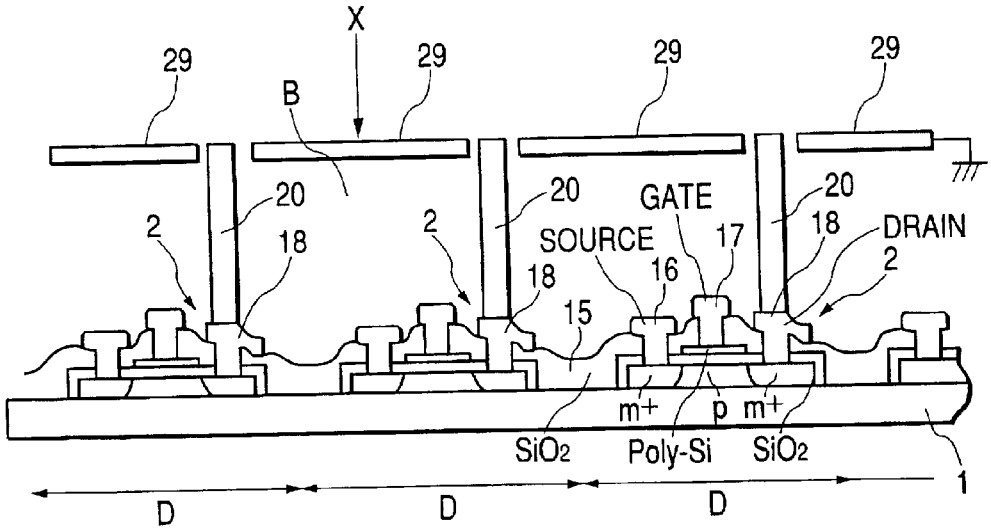
FIG. 15A is a vertical cross-sectional view of a switching element of the tenth embodiment.
Figure 15B:
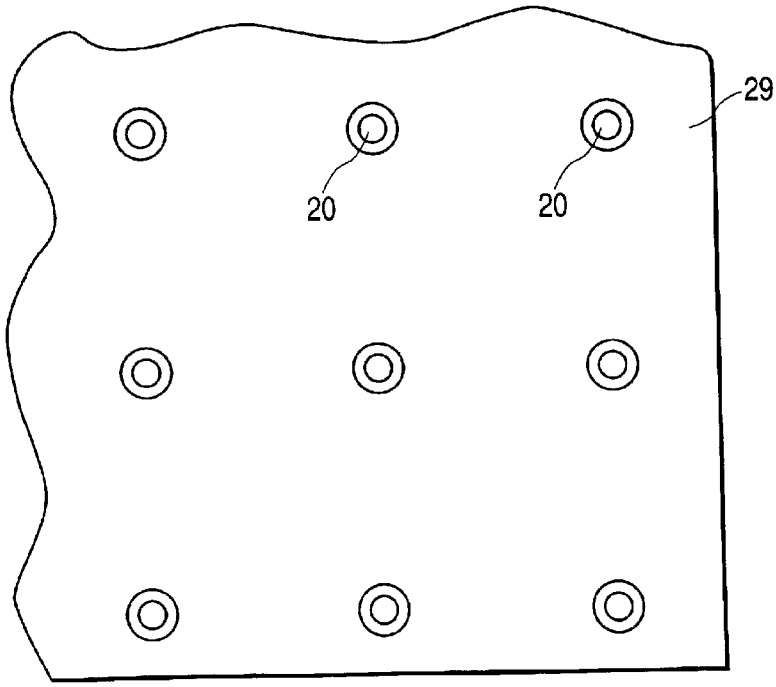
FIG. 15B is an arrow diagram taken in the direction of arrow X in FIG. 15A.

The tenth embodiment is shown in FIGS. 15A and 15B.

In this embodiment, a conductive shield 29 is provided so as to prevent a situation where an unnecessary electric field other than an electric field generated from the metallic electrode 20 arranged at (connected to) the drain 18 of the switching element 2 forms an electric line of force at the developing sleeve 32.

FIG. 15A is a vertical cross-sectional view of the switching element 2, while FIG. 15B is an arrow diagram taken in the direction of arrow X in FIG. 15A. As can be seen from these drawings, the shield 29 covers almost all of the surface of the drum 1 except for each portion in which the metallic electrode exists. Note that although not shown in these drawings, it is preferable that $SiO_2$, polyimide resin, Teflon (registered trademark) resin, or the like is filled between (in a portion specified by legend "B") the switching element 2, the metallic electrode 20, and the shield 16 to fix these construction elements.

By providing the conductive shield 29 like this, it becomes possible to achieve an effect that is the same as the effect of the ninth embodiment described above. That is, it becomes possible to prevent a situation where the toner on the developing sleeve 32 adheres to portions that do not contribute to image formation. Note that the metallic electrode 20 and the shield 29 described above may be wholly covered with an insulating material as described above. Even in this case, as necessary, the metallic electrode 20 may be exposed.

In the above description, there has been described a case where a silicon (Si) substrate is used, although it is possible to obtain the same effect even with another semiconductor material, such as an organic semiconductor, zinc oxide, or selenium.

In the first to tenth embodiments described above, there has been described an example in which the switching element 2 is formed on a silicon (Si) substrate. However, the present invention is not limited to this. For instance, aside from silicon, it is possible to obtain the same effect even with another semiconductor material, such as an organic semiconductor, zinc oxide, or selenium.

It has been confirmed that in the case where an organic semiconductor is used, it is possible to obtain the same effect using a p-type or n-type organic semiconductor as the semiconductor layers 12 and 14 described with reference to FIGS. 3A to 3G. The p-type organic semiconductor is formed by vacuum-depositing an oligothiophene, pentacene, bis-benzodithiophene and phthalocyanine semiconductor, an anthradithiophene semiconductor, poly(3-alkylthiophene), partial regular poly(3-alkylthiophene), or the like. Alternatively, the p-type organic semiconductor is formed by applying a solvent obtained by dissolving these materials using chlorobenzene or 1-2-4-trichlorobenzene aromatic solvent.

Also, the n-type organic semiconductor is formed by vacuum-depositing a phthalocyanine fluoride conjugated polymer, perylenetetracarboxyl dianhydride and imide dielectric substance, a naphthalenetetracarboxyl dianhydride and imide dielectric substance, C60, 11,11,12,12,-tetracyanonaphtho-2,6-quinodimethane. Alternatively, it is possible to use N, N'-diphenyl-N, N'-bis(3-methylphenyl)-1, biphenyl, or the like. As to an organic semiconductor used for 12 or 14, it is enough that the p-type organic semiconductor and the n-type organic semiconductor are selected from the substances described above. Also, in the case where the n-type organic semiconductor and the p-type organic semiconductor are respectively used, it is enough that the polarity of a voltage applied between the source and drain is changed. Also, it is possible to form a negative image by reversing the polarity of toner or the polarity of a developing bias in accordance with the change of the polarity of the applied voltage.

Also, there occurs no problem if a resin, in which conductive particles of ITO, silver, carbon, or the like are basically dispersed, is used as conductive layers of the source 16, the gate 17, and the drain 18.

Also, it is enough that the insulating layers 13 and 15 are formed using polyimide or polymetamethylacrylate.

It should be noted here that in the case where the construction described above is produced, it is possible to produce this construction on the upper surface of a drum by repeating a method, with which there is produced the construction described in the article of Seiko Epson Corporation "Ink Jet Usage Circuit" published by The Nikkei Business Daily on Feb. 28, 2001, or silk printing in a plurality of manufacturing steps.

As described above, with the technique of the present invention, it becomes possible to reduce the overall size of an image forming apparatus, to clearly form a color image, and to shorten the time taken by image formation.

The present invention is not limited to the embodiments described above but various modifications are possible without departing from the scope of the technical idea of the present invention.

What is claimed is:

1. An image forming apparatus comprising:

an image bearing member including a plurality of switching elements that are arranged in a moving direction and a generatrix direction of said image bearing member; and latent image forming means for forming a latent image on said image bearing member, said latent image forming means including a voltage generating means for generating a voltage in each switching element in accordance with an image signal, wherein each switching element corresponds to one dot of pixels of the latent image, and wherein a peripheral length of said image bearing member in the moving direction is an integral multiple of the dot.

2. An image forming apparatus according to claim 1, wherein each switching element includes electrodes and at least one of said electrodes is formed using an organic semiconductor.

3. An image forming apparatus according to claim 1, wherein said image bearing member has a drum shape.

4. An image forming apparatus according to claim 1, further comprising a developing apparatus that develops the latent image using a developer, wherein said developing apparatus includes a developer carrying member that carries the developer to a developing position.

5. An image forming apparatus according to claim 4, wherein the developer is one-component developer including toner.

6. An image forming apparatus according to claim 4, wherein the developer is two-component developer including toner and carrier.

7. An image forming apparatus according to claim 4, wherein the developer is developer produced by dispersing toner in an insulation liquid.

8. An image forming apparatus according to claim 4, wherein:

a toner image is formed on said image bearing member by said developer carrying member;

said image forming apparatus further comprises density detecting means for detecting a density of the toner image formed on said image bearing member; and a voltage applied to said developer carrying member is set on the basis of a detection result of said density detecting means.

9. An image forming apparatus according to claim 4, further comprising a plurality of image forming portions that each includes said image bearing member and said developing apparatus, wherein said plurality of developing apparatuses contain toner in different colors.

10. An image forming apparatus according to claim 1, further comprising transferring means for transferring a toner image formed on said image bearing member to an image receiving member, wherein each switching element generates heat during the transferring by said transferring means.

11. An image forming apparatus comprising:

an image bearing member including a plurality of switching elements that are arranged in a moving direction and a generatrix direction of said image bearing member;

latent image forming means for forming a latent image on said image bearing member, said latent image forming means including a voltage generating means for generating a voltage in each switching element in accordance with an image signal; and optical communications means for inputting the image signal into each switching element.

12. An image forming apparatus according to claim 11, wherein said optical communications means includes:

a light-receiving unit that is provided in a non-image area of said image bearing member in which no image is formed; and a light-emitting unit that irradiates said light-receiving unit with light.

13. An image forming apparatus comprising:

an image bearing member including a plurality of switching elements that are arranged in a moving direction and a generatrix direction of said image bearing member;

latent image forming means for forming a latent image on said image bearing member, said latent image forming means including a voltage generating means for generating a voltage in each switching element in accordance with an image signal; and radio wave communications means for inputting the image signal into each switching element.

14. An image forming apparatus comprising:

an image bearing member including a plurality of switching elements that are arranged in a moving direction and a generatrix direction of said image bearing member;

latent image forming means for forming a latent image on said image bearing member, said latent image forming means including a voltage generating means for generating a voltage in each switching element in accordance with an image signal; and a developing apparatus that develops the latent image using a developer, wherein said developing apparatus includes a developer carrying member that carries the developer to a developing position, wherein a toner image is formed on said image bearing member by said developer carrying member, wherein said image forming apparatus further comprises density detecting means for detecting a density of the toner image formed on said image bearing member, and wherein a voltage applied to each switching element is set on the basis of a detection result of said density detecting means.

15. An image forming apparatus comprising:

an image bearing member including a plurality of switching elements that are arranged in a moving direction and a generatrix direction of said image bearing member; and latent image forming means for forming a latent image on said image bearing member, said latent image forming means including a voltage generating means for generating a voltage in each switching element in accordance with an image signal, wherein each switching element includes a plurality of electrodes, and wherein an image forming electrode, out of said plurality of electrodes, which forms the latent image is provided so as to protrude outward in comparison with other electrodes.

16. An image forming apparatus according to claim 15, wherein when a length of a portion of said image forming electrode that protrudes in comparison with other electrodes is referred to as L, a cross-sectional area of a pixel of the latent image in a direction along a surface of said image bearing member is referred to as S1, a density of the pixel is referred to as D, and a cross-sectional area of said image forming electrode in the direction along the surface of said image bearing member is referred to as S2, the following relation exists among S1, D, and S2

$$L \geqq S1 \times D / S2.$$

17. An image forming apparatus according to claim 15, further comprising a conductive shield that covers each switching element, wherein said shield includes an opening portion corresponding to said image forming electrode so that said image forming electrode is exposed.

18. An image forming apparatus according to claim 17, wherein said conductive shield and said image forming electrode are covered with an insulating member.

* * * * *